US006048277A

United States Patent [19]

Raymond

[11] Patent Number: 6,048,277

[45] Date of Patent: Apr. 11, 2000

[54] GOLF CLUB HEAD HAVING UPWARDLY DIRECTED AND OPPOSING, OBLIQUE SCORE LINES

[76] Inventor: David Raymond, 26 Pamela Ct., Tolland, Conn. 06084

[21] Appl. No.: 09/114,678

[22] Filed: Jul. 13, 1998

[51] Int. Cl.[7] ..... A63B 53/04

[52] U.S. Cl. ..... 473/331

[58] Field of Search ..... 473/324, 330, 473/331, 342

[56] References Cited

U.S. PATENT DOCUMENTS

| | | | |
|---|---|---|---|
| D. 55,278 | 5/1920 | Kraeuter . | |
| D. 193,098 | 6/1962 | Davis . | |
| D. 210,033 | 1/1968 | Johnston . | |
| 956,594 | 5/1910 | Myles . | |
| 2,005,401 | 6/1935 | Storz . | |
| 2,034,936 | 3/1936 | Barnhart | 473/331 |
| 4,679,792 | 7/1987 | Straza | 473/331 |
| 5,423,546 | 6/1995 | Manning et al. . | |
| 5,505,450 | 4/1996 | Stuff . | |
| 5,643,099 | 7/1997 | Solheim . | |
| 5,766,087 | 6/1998 | Kawamatsu | 473/331 |
| 5,785,610 | 7/1998 | Birmingham | 473/331 |

*Primary Examiner*—Sebastiano Passaniti
*Attorney, Agent, or Firm*—Cummings & Lockwood

[57] ABSTRACT

A golf club head has a sweet spot defined by a central axis of the club face, and an elongated smooth surface extending in its elongated direction along at least a portion of the central axis and overlying the sweet spot. A first set of approximately parallel score lines are located on one side of the central axis, and a second set of approximately parallel score lines are located on an opposite side of the central axis. Each score line is oriented upwardly at an oblique angle relative to the central axis to impart spin about spin axes extending approximately in a direction of the score lines and at oblique angles relative to the central axis of the club face for correcting a direction of impact resulting from mishitting the ball toward the toe portion or the heel portion of the club face.

19 Claims, 1 Drawing Sheet

GOLF CLUB HEAD HAVING UPWARDLY DIRECTED AND OPPOSING, OBLIQUE SCORE LINES

FIELD OF THE INVENTION

The present invention relates generally to a golf club head, and more particularly, to a golf club head having upwardly directed score lines on the club face.

BACKGROUND OF THE INVENTION

A golf club head defines a sweet spot typically located centrally on the club face relative to the heel and toe. The sweet spot is defined as the area around the center of mass of a club head that is the most effective part of the face with which to strike a golf ball. The center of mass (or center of the sweet spot) is typically provided along a center line of the club face extending from an upper edge to a lower edge of the club head. It is desirable to strike a golf ball on the sweet spot of the club face in order to impart a straight trajectory to the ball and to better ensure that the ball lands where desired. Mishitting the golf ball near the heel of the club face of a right-handed club results in pivoting the club face leftwardly and, in turn, imparting a leftward trajectory to the ball. Similarly, mishitting the golf ball near the toe of the club face results in pivoting the club face rightwardly and, in turn, imparting a rightward trajectory to the ball.

Golf club heads are known to provide different types of score lines designed to correct the trajectory of mishit golf balls. U.S. Pat. No. 5,505,450 shows a golf club head that has three sets of grooves. Two sets of upwardly directed grooves respectively provided near the toe and heel portions permit corrective spins to a mishit ball in order to straighten the ball trajectory. A center set of horizontal grooves provides spin, but no trajectory correction. A drawback with this type of golf club head is that the ball receives little or no corrective spin from the upwardly directed grooves, unless the face strikes the ball a substantial distance from the center of the face beyond the horizontal grooves toward either the heel or toe.

In response to the foregoing, it is an object of the present invention to provide a golf club head that overcomes the drawbacks and disadvantages of prior art golf club heads.

SUMMARY OF THE INVENTION

The present invention is directed to a golf club head which includes a hosel for attaching the club head to a club shaft. A club face defines a heel portion adjacent to the hosel, a toe portion located on an opposite side of the face relative to the heel portion, a leading edge extending between the toe portion and the heel portion at a lower portion of the face, and a trailing edge extending between the toe portion and the heel portion at an upper portion of the face. The club face defines a sweet spot immediately surrounding a center of mass of the club head, and a central axis of the club face extends through the sweet spot. An elongated smooth surface extends in its elongated direction along at least a portion of the central axis and overlies the sweet spot. A first set of approximately parallel score lines are located on one side of the central axis, and a second set of approximately parallel score lines are located on an opposite side of the central axis. Each score line is oriented upwardly at an oblique angle relative to the central axis for imparting an oblique spin to a golf ball to, in turn, compensate for the direction of impact when mishitting the ball toward the toe portion or the heel portion of the club face. Preferably, the score lines are v-shaped in cross-section.

One advantage of the present invention is that the score lines are located near the center of the sweet spot so as to provide corrective spin even when the club face strikes a golf ball only slightly off of the center of the sweet spot toward the toe portion or the heel portion of the club face.

Other objects and advantages of the present invention will become apparent in view of the following detailed description and accompanying drawings.

DETAILED DESCRIPTION OF THE PREFERRED EMBODIMENT

Figure 1:
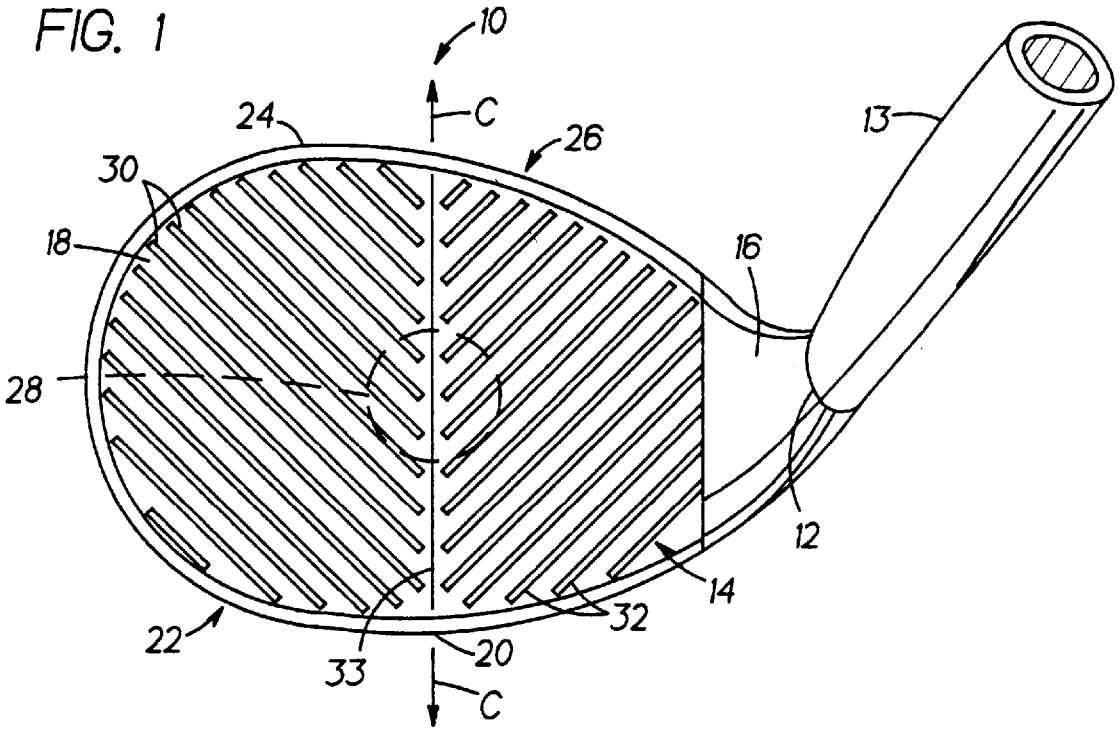
FIG. 1 is a perspective view of a golf club head having on its face oblique, upwardly directed score lines in accordance with the present invention.

Referring to FIG. 1, a golf club head embodying the present invention is generally designated by the reference number 10. The golf club head to be illustrated and described is for right-handed players, but it will be understood that the present invention also applies to a golf club head for left-handed players in which the structure, as well as spin and ball trajectory imparted by the left-handed club head is a mirror image of the right-handed club head 10.

The club head 10 includes a hosel 12 for attaching the club head to a club shaft 13. The club head 10 further includes a club face 14 for striking a golf ball. The club face 14 defines a heel portion 16 adjacent to the hosel 12, and a toe portion 18 located on an opposite side of the face 14 relative to the heel portion 16. The club face 14 further defines a leading edge 20 extending between the toe portion 18 and the heel portion 16 at a lower portion 22 of the face, and a trailing edge 24 extending between the toe portion 18 and the heel portion 16 at an upper portion 26 of the face.

The club face 14 includes a sweet spot 28 which is the most effective part of the face with which to strike a golf ball in order to impart a straight trajectory to the ball, and to best ensure that the ball lands at a desired target, such as a fairway or putting green. As discussed above, and indicated by the broken lines in FIG. 1, the sweet spot 28 is the area on the club face 14 immediately surrounding the center of mass of the golf club head 10. As also shown in FIG. 1, in the preferred embodiment, a center line or central axis "C" of the club head 10 extends through the center of the sweet spot 28. Also in the preferred embodiment, the center line or central axis C is located along its extent approximately midway between the heel portion 16 and the toe portion 18 of the club face 14, and extends from the upper portion 26 to the lower portion 22 of the club face.

The club head 10 further includes first means extending between the central axis or center line C and the toe portion 18 of the face 14 for generating spin to a golf ball to compensate for the direction of impact due to striking the ball toward the toe portion 18. The first means includes a first plurality of substantially parallel grooves or score lines 30 approximately equally spaced relative to each other and extending between the center line C and the toe portion 18. Each score line 30 extends upwardly along an approximately straight line at an oblique angle relative to the central axis C from a first point adjacent to the central axis C to a second point located along the margin of the club face. The club head 10 further includes a second means extending between the central axis or center line C and the heel portion 16 of the face 14 for generating spin to a golf ball to compensate for the direction of impact due to striking the ball toward the heel portion 16. The second means includes a second plurality of substantially parallel grooves or score lines 32 approximately equally spaced relative to each other and extending between the center line C and the heel portion 16. Each score line 32 extends upwardly along an approximately straight line at an oblique angle relative to the central axis C from a first point adjacent to the central axis to a second point located along the margin of the club face. Preferably, the first and the second sets of score lines 30, 32 each extend upwardly at an angle of approximately 45° relative to the center line C. However, as will be recognized by those skilled in the pertinent art based on the teaching herein, other oblique angles may be equally employed. The oblique angle of the score lines 30, 32, along with the substantial percentage of club face surface area covered by the score lines permits a substantially greater score line surface area in which to engage and thereby correct the direction of impact or trajectory of a mishit golf ball as compared to the score lines of prior art golf club heads.

As shown in FIG. 1, the inner ends of the first and the second sets of score lines 30, 32 on the face 14 are located adjacent to the center line or central axis C and are closely spaced from one another on opposite sides of the central axis so as to define an elongated smooth surface 33 centered on and extending along the central axis between the opposing score lines 30, 32. Preferably, and as shown in FIG. 1, a portion of the score lines 30, 32 extend into the sweet spot 28 to provide spin compensation when a ball is struck even slightly off of the center of the sweet spot.

Figure 2:
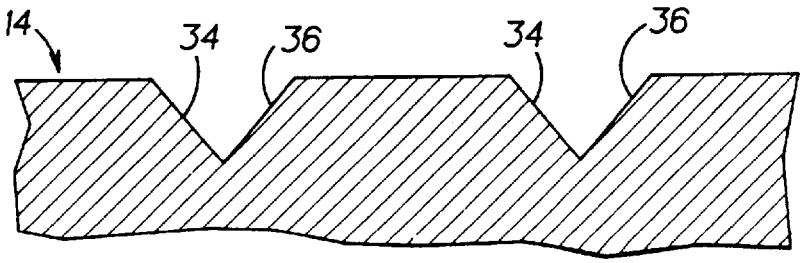
FIG. 2 is a partial, cross-sectional view of the club head of FIG. 1 showing the v-shaped score lines.

As shown in FIG. 2, each of the score lines 30 or 32 form v-shaped cross-sections in the club face 14. The two sides forming the v-shaped cross-section are defined by first and second surfaces 34 and 36 extending inwardly into the face 14 and converging with one another below the face at 37. Preferably, each pair of the first and the second surfaces 34, 36 are oriented approximately perpendicular relative to each other. It has been found that the v-shaped cross-section of the score lines 30, 32 effectively engages the surface of a golf ball to impart an enhanced spin to the golf ball. The enhanced spin, in turn, provides effective lift to the golf ball, and is particularly advantageous when hitting a golf ball out of a sand trap.

In operation, when the face 14 strikes a golf ball on the sweet spot 28, the face 14 of club head 10 remains square or normal to the direction toward the desired target, which is typically a fairway or putting green, to thereby impart a straight or forward trajectory to the ball (when ignoring natural factors affecting ball trajectory such as the speed and direction of wind). Further, a plurality of the score lines 30, 32 near the central axis C engage the ball surface to provide spin thereto. The spins imparted by the score lines 30 or 32 are oblique (i.e., the golf ball spins about an axis oriented at an oblique angle relative to the central axis C). Specifically, the first set of score lines 30 provide a first oblique spin component about an axis of the ball extending approximately in the same direction as the score lines 30, and the second set of score lines 32 likewise provide a second oblique spin component about a first spin axis of the ball extending approximately in the direction of the score lines 32. The simultaneous contact of the ball with the score lines 30, 32 at the sweet spot 28 results in a straight trajectory to the ball.

When the face 14 strikes a golf ball toward the toe portion 18, the inertial mass of a ball impacting the club head 10 retards the forward motion of the toe portion 18 of the club face 14 relative to the heel portion 16, which in turn causes the face 14 to pivot rightwardly about the center of mass of the club head 10 (i.e., the club face 14 opens). The opening club face imparts a direction of impact to the ball having a rightward trajectory component. Also, as the face 14 strikes the ball, the first set of score lines 30 located between the central axis C and the toe portion 18 impart an oblique spin to the ball about a first spin axis extending approximately in the direction of the score lines 30 and oriented at an oblique angle relative to the central axis of the club face 14 which results in generating a leftward trajectory component to the ball. This leftward trajectory component imparted by the first set of score lines 30 tends to correct or compensate for the direction of impact or rightward trajectory component imparted by the rightward facing club face 14 to, in turn, direct the ball back inwardly toward the desired target.

When the face 14 strikes a golf ball toward the heel portion 16, the inertial mass of the ball impacting the club head 10 retards the forward motion of the heel portion 16 of the club face 14 relative to the toe portion 18, which in turn causes the face 14 to pivot leftwardly about the center of mass of the club head 10 (i.e., the club face 14 closes). The closing club face imparts a direction of impact to the golf ball having a slightly leftward trajectory component. Also, as the face 14 strikes the ball, the second set of score lines 32 located between the central axis C and the heel portion 16 impart an oblique spin to the ball about a second spin axis extending approximately in the direction of the score lines 32 and oriented at an oblique angle relative to the central axis of the club face 14 which results in generating a rightward trajectory component to the ball. This rightward trajectory component imparted by the second set of score lines 32 tends to correct or compensate for the direction of impact or leftward trajectory component imparted by the leftward facing club face 14 to, in turn, direct the ball back inwardly toward the desired target.

As will be recognized by those skilled in the pertinent art, numerous modifications and substitutions may be made to the above-described and other embodiments of the present invention without departing from the scope of the invention as set forth in the appended claims. For example, the score lines may be upwardly oriented at other oblique angles relative to the central axis. The score lines may also be defined in the face as broken lines, or may be defined by different cross-sectional shapes. Accordingly, the preceding portion of this specification is to be taken in an illustrative, as opposed to a limiting sense.

What is claimed is:

1. A golf club head comprising:

a hosel for attaching the club head to a club shaft;

a club face defining a heel portion adjacent to the hosel, a toe portion located on an opposite side of the face relative to the heel portion, a leading edge extending between the toe portion and the heel portion along a lower portion of the face, a trailing edge extending between the toe portion and the heel portion along an upper portion of the face, a sweet spot defined by an axis of the club face, an elongated smooth surface extending in its elongated direction along at least a portion of the axis and overlying the sweet spot, a plurality of first elongated raised surfaces and first elongated recessed surfaces spaced relative to each other between the first elongated raised surfaces, wherein the first elongated raised surfaces and first elongated recessed surfaces extend between the toe portion and the elongated axis of the club face, and extend downwardly in a direction from the toe portion to the axis, and wherein the first elongated recessed surfaces define a first set of approximately parallel score lines, and each first elongated raised surface is contiguous to at least one respective first score line and extends from one end to the other end of the respective first score line, and a plurality of second elongated raised surfaces and second elongated recessed surfaces spaced relative to each other between the second elongated raised surfaces, wherein the second elongated raised surfaces and second elongated recessed surfaces extend between the heel portion and the elongated axis of the club face, and extend downwardly in a direction from the heel portion to the axis, and wherein the second elongated recessed surfaces define a second set of approximately parallel score lines, and each second elongated raised surface is contiguous to at least one respective second score line and extends from one end to the other end of the respective second score line, and wherein each score line is oriented upwardly at an oblique angle relative to the axis of the club face.

2. A golf club head as defined in claim 1, wherein at least a plurality of score lines extend into the sweet spot.

3. A golf club head as defined in claim 1, wherein the elongated smooth surface extends from approximately the trailing edge to approximately the leading edge of the club face.

4. A golf club head as defined in claim 1, wherein the elongated smooth surface is located approximately midway between the toe portion and the heel portion of the club face.

5. A golf club head as defined in claim 1, wherein the central axis extends in a direction from the upper portion to the lower portion between the toe portion and the heel portion, and the first and the second sets of score lines extend upwardly at an oblique angle of approximately 45° relative to the central axis.

6. A golf club head as defined in claim 1, wherein a plurality of the first and second score lines are v-shaped in cross-section.

7. A golf club head as defined in claim 6, wherein each of the score lines is defined by first and second surfaces extending inwardly into the club face, and each pair of first and second surfaces are oriented approximately perpendicular relative to each other.

8. A golf club head as defined in claim 1, wherein each of the first set of score lines extends from approximately the smooth surface to a margin of the toe portion, and each of the second set of score lines extends from approximately the smooth surface to a margin of the heel portion.

9. A golf club head as defined in claim 1, wherein the axis is coincident with the center line of the club face.

10. A golf club head comprising:

a hosel for attaching the club head to a club shaft;

a club face defining a heel portion adjacent to the hosel, a toe portion located on an opposite side of the face relative to the heel portion, a leading edge extending between the toe portion and the heel portion at a lower portion of the face, a trailing edge extending between the toe portion and the heel portion at an upper portion of the face, a sweet spot defined by an axis of the club face, an elongated smooth surface extending in its elongated direction along at least a portion of the axis and overlying the sweet spot, first means located between the smooth surface and the toe portion for generating spin to a golf ball about a first spin axis, wherein the first means extends downwardly in a direction from the toe portion to the axis and is oriented at an oblique angle relative to the axis of the club face to compensate for the direction of impact due to striking a golf ball toward the toe portion, and second means located between the axis of the club face and the heel portion for generating spin to a golf ball about a second spin axis, wherein the second means extends downwardly in a direction from the heel portion to the axis and is oriented at an oblique angle relative to the axis of the club face to compensate for the direction of impact due to striking a golf ball toward the heel portion, and wherein the first and the second means each define a plurality of elongated raised surfaces and parallel elongated recessed surfaces spaced relative to each other between the elongated raised surfaces and the elongated raised surfaces are contiguous to respective elongated recessed surfaces and extend from one end to the other of the respective recessed surfaces.

11. A golf club head as defined in claim 10, wherein the first means extends from approximately the axis to a margin of the toe portion, and the second means extends from approximately the axis to a margin of the heel portion.

12. A golf club head as defined in claim 10, wherein the elongated smooth surface extends from approximately the trailing edge to approximately the leading edge of the club face.

13. A golf club head as defined in claim 10, wherein the elongated smooth surface is located approximately midway between the toe portion and the heel portion of the club face.

14. A golf club head as defined in claim 10, wherein the elongated recessed surfaces of the first means define a first set of approximately parallel score lines located on one side of the axis, the elongated recessed surfaces of the second means define a second set of approximately parallel score lines located on an opposite side of the axis, and each score line is oriented upwardly at an oblique angle relative to the axis.

15. A golf club head as defined in claim 14, wherein at least a plurality of score lines extend into the sweet spot.

16. A golf club head as defined in claim 14, wherein the axis extends in a direction from the upper portion to the lower portion between the toe portion and the heel portion, and the first and the second sets of score lines extend upwardly at an oblique angle of approximately 45° relative to the central axis.

17. A golf club head as defined in claim 14, wherein each of the first set of score lines extends from approximately the smooth surface to a margin of the toe portion, and each of the second set of score lines extends from approximately the smooth surface to a margin of the heel portion.

18. A golf club head as defined in claim 14, wherein a plurality of the first and second score lines are v-shaped in cross-section.

19. A golf club head as defined in claim 18, wherein each of the score lines is defined by first and second surfaces extending inwardly into the club face, and each pair of first and the second surfaces are oriented approximately perpendicular relative to each other.

* * * * *